US010583672B2

(12) United States Patent
Araishi

(10) Patent No.: US 10,583,672 B2
(45) Date of Patent: Mar. 10, 2020

(54) SHEET CONVEYING DEVICE, IMAGE READING DEVICE, IMAGE FORMING APPARATUS

(71) Applicant: KYOCERA Document Solutions Inc., Osaka-shi, Osaka (JP)

(72) Inventor: Kuniaki Araishi, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 16/126,779

(22) Filed: Sep. 10, 2018

(65) Prior Publication Data

US 2019/0077169 A1 Mar. 14, 2019

(30) Foreign Application Priority Data

Sep. 14, 2017 (JP) ..... 2017-176644

(51) Int. Cl.
*B65H 31/26* (2006.01)
*B65H 29/22* (2006.01)
(Continued)

(52) U.S. Cl.
CPC ..... *B41J 11/007* (2013.01); *B41J 11/0055* (2013.01); *B41J 11/04* (2013.01); *B65H 5/062* (2013.01); *B65H 29/125* (2013.01); *B65H 29/14* (2013.01); *B65H 29/22* (2013.01); *B65H 29/52* (2013.01); *B65H 29/70* (2013.01);
(Continued)

(58) Field of Classification Search
CPC ..... B65H 31/26; B65H 29/12; B65H 29/125; B65H 29/14; B65H 29/145; B65H 29/52; B65H 29/70; B65H 2301/33312; B65H 29/22
See application file for complete search history.

(56) References Cited

U.S. PATENT DOCUMENTS 4,916,493 A * 4/1990 DeVito ..... B65H 3/44 271/186
5,014,976 A * 5/1991 Muck ..... B65H 29/14 271/220
(Continued)

FOREIGN PATENT DOCUMENTS

JP 2000062966 A 2/2000
JP 2010001107 A * 1/2010

*Primary Examiner* — Luis A Gonzalez
(74) *Attorney, Agent, or Firm* — Alleman Hall Creasman & Tuttle LLP

(57) ABSTRACT

A sheet conveying device includes a discharging roller pair, a discharge sheet holding portion, and a stopper member. The discharging roller pair discharges the sheet member outside from a sheet discharge port by rotating in a forward rotational direction. The discharging roller pair includes a first conveying roller, and a roller member. The discharge sheet holding portion is for holding the sheet member discharged outside by the discharging roller pair. The stopper member is swingably supported on a rotational shaft of the first conveying roller. The stopper member allows the sheet member to be discharged to the discharge sheet holding portion when the discharging roller pair rotates in the forward rotational direction, and prevents the sheet member from intruding into the nip portion from the discharge sheet holding portion when the discharging roller pair rotates in the reverse rotational direction.

5 Claims, 7 Drawing Sheets

(51) Int. Cl.

| | |
|---|---|
| ***B65H 29/14*** | (2006.01) |
| ***B65H 29/52*** | (2006.01) |
| ***B41J 11/00*** | (2006.01) |
| ***B41J 11/04*** | (2006.01) |
| ***B65H 5/06*** | (2006.01) |
| ***B65H 29/12*** | (2006.01) |
| ***B65H 31/02*** | (2006.01) |
| ***B65H 29/70*** | (2006.01) |

(52) U.S. Cl.

CPC ..... *B65H 31/02* (2013.01); *B65H 31/26* (2013.01); *B65H 2301/4212* (2013.01); *B65H 2403/942* (2013.01); *B65H 2404/725* (2013.01); *B65H 2405/1134* (2013.01); *B65H 2801/39* (2013.01)

(56) References Cited

U.S. PATENT DOCUMENTS

| | | | | |
|---|---|---|---|---|
| 6,983,122 | B2 * | 1/2006 | Hayamizu | B41J 3/60 271/184 |
| 7,954,806 | B2 * | 6/2011 | Saito | B65H 29/70 271/186 |
| 8,087,666 | B2 * | 1/2012 | Honda | B41J 13/0036 271/207 |
| 9,227,811 | B2 * | 1/2016 | Yamada | B65H 29/14 |
| 9,352,916 | B2 * | 5/2016 | Nishii | B65H 29/14 |
| 9,409,743 | B2 * | 8/2016 | Arimura | B65H 29/52 |
| 2004/0140606 | A1 * | 7/2004 | Kobayashi | B65H 29/58 271/4.01 |

* cited by examiner

SHEET CONVEYING DEVICE, IMAGE READING DEVICE, IMAGE FORMING APPARATUS

INCORPORATION BY REFERENCE

This application is based upon and claims the benefit of priority from the corresponding Japanese Patent Application No. 2017-176644 filed on Sep. 14, 2017, the entire contents of which are incorporated herein by reference.

BACKGROUND

The present disclosure relates to a sheet conveying device for conveying a sheet member, and an image reading device and an image forming apparatus including the sheet conveying device including a conveying roller configured to be rotatable in a forward rotational direction and a reverse rotational direction.

The image reading device such as a scanner is provided with an automatic document feeder (hereinafter referred to as "ADF") for automatically conveying a document sheet set in a sheet feeding tray. The ADF includes a feeding roller for feeding inside the document sheet set in the sheet feeding tray, and a discharging roller for discharging the document sheet to an external discharge tray. The document sheet conveyed to a reading position by the feeding roller is discharged to the discharge tray by the discharging roller.

In an image reading device including the ADF as described above, conventionally, there is known a stopper member for preventing the document sheet in the discharge tray from being drawn into the discharging roller, when the discharging roller is rotated in a rotational direction opposite to that at a time of discharge. The stopper member is configured to prevent a rear end of the document sheet from coming in contact with a surface of the discharging roller for discharging the document sheet.

SUMMARY

A sheet conveying apparatus according to an embodiment of the present disclosure includes a discharge path, a discharging roller pair, a discharge sheet holding portion, and a stopper member. The discharge path guides a sheet member to a sheet discharge port. The discharging roller pair is configured to be rotatable in a forward rotational direction and a reverse rotational direction, and discharges the sheet member outside from the sheet discharge port by rotating in the forward rotational direction. The discharging roller pair includes a first conveying roller and a roller member which is provided beneath the first conveying roller and configured to come in contact with a roller surface of the first conveying roller, forming a nip portion between the first conveying roller and the roller member. The discharge sheet holding portion is for holding the sheet member discharged outside by the discharging roller pair. The stopper member is swingably supported on a rotational shaft of the first conveying roller, and projects toward an intersecting direction, intersecting the sheet discharge port on a side further downstream than the nip portion in a discharge direction of the sheet member. The stopper member allows the sheet member to be discharged to the discharge sheet holding portion when the discharging roller pair rotates in the forward rotational direction, and prevents the sheet member from intruding into the nip portion from the discharge sheet holding portion when the discharging roller pair rotates in the reverse rotational direction.

An image reading device according to another embodiment of the present disclosure includes the sheet conveying device, and is configured to read an image from the sheet member being conveyed by the sheet conveying device.

An image forming apparatus according to another embodiment of the present disclosure includes the sheet conveying device, and is configured to form an image on the sheet member being conveyed by the sheet conveying device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the accompanying drawings. It should be noted that the following embodiments are examples of specific embodiments of the present disclosure and should not limit the technical scope of the present disclosure.

Figure 1:
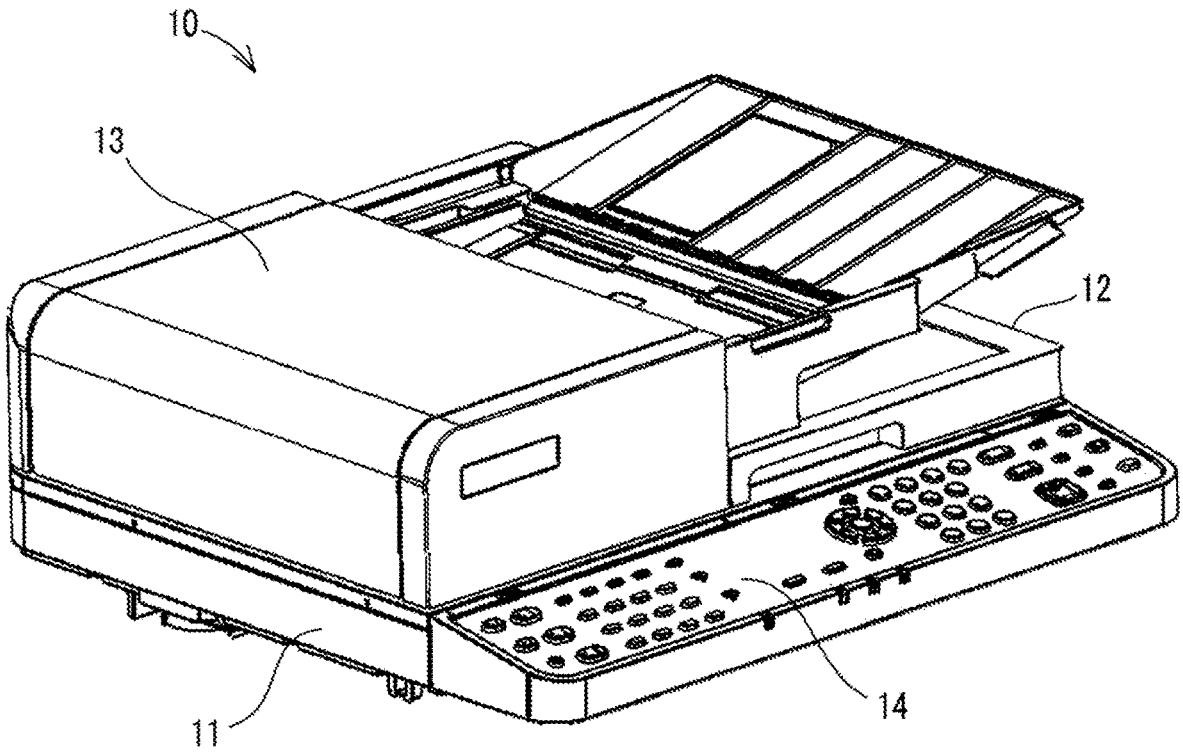
FIG. 1 is a perspective diagram showing a configuration of an image reading device according to an embodiment of the present disclosure.

An image reading device 10 is used attached to an upper portion of an image forming apparatus capable of forming an image on printing paper. The image reading device 10 is configured to perform an image reading process for reading image data from a document sheet (an example of a sheet member), and as shown in FIG. 1, the image reading device 10 includes an image reading portion 11, a document sheet cover 12, an automatic document feeder 13 (an example of a sheet conveying device, hereinafter referred to as ADF 13), and an operation panel 14. In the present embodiment, the image reading device 10 reads image data from a document sheet placed on a contact glass 21 described below (see FIG. 2), or from a document sheet conveyed by the ADF 13.

Figure 2:
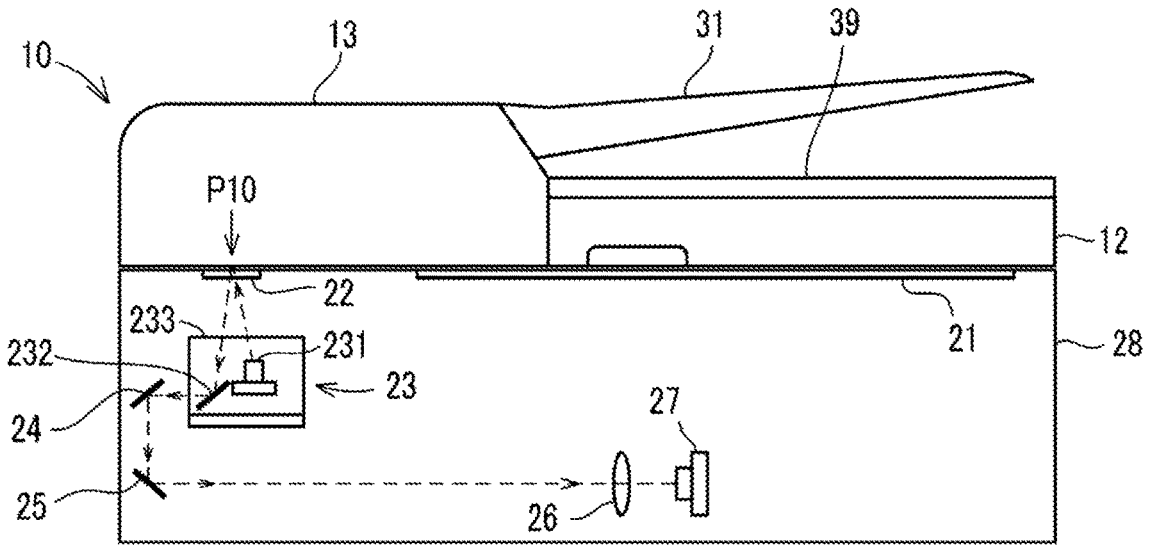
FIG. 2 is a cross-sectional diagram showing an internal configuration of the image reading device.

As shown in FIG. 2, the image reading portion 11 includes, within a housing 28, contact glasses 21 and 22, a reading unit 23, mirrors 24 and 25, an optical lens 26, and a CCD 27. In addition, the image reading portion 11 includes a control portion (not shown) including computing elements such as a CPU, a ROM, and a RAM. This control portion collectively controls various operations such as an image reading operation.

Both of the contact glasses 21 and 22 are attached to an upper portion of the housing 28, and are supported horizontally by the housing 28. The contact glass 21 is a portion on which a document sheet from which an image is read is placed. The contact glass 22 is a portion through which light irradiated from the reading unit 23 toward the document sheet being conveyed by the ADF 13 is passed. This contact glass 22 is a plate-like member formed elongated in a main scanning direction, and narrow in a sub-scanning direction (a direction orthogonal to the main scanning direction). The contact glasses 21 and 22 are formed in a flat plate shape using transparent material such as glass, transparent resin, or the like.

The reading unit 23 includes, supported by a carriage 233, an LED light source 231 and a mirror 232. The carriage 233 of the reading unit 23 is configured to be movable in a left-right direction in FIG. 2 (the sub-scanning direction), by a movement mechanism (not shown) using a driving motor such as a stepping motor. Light is irradiated from the LED light source 231 toward the contact glass 21 or the contact glass 22.

When light is irradiated from the LED light source 231 toward the document sheet, the mirror 232 reflects light reflected off a back surface (an opposite surface) of the document sheet toward a mirror 24. The light reflected by the mirror 232 is guided to the optical lens 26 by the mirrors 24 and 25. The light is then condensed and made incident on the CCD 27 by the optical lens 26.

The CCD 27 is a photoelectric converting element for converting the incident light into an electric signal (a voltage) corresponding to an amount of the light (an intensity of luminance), and outputting the electric signal to the control portion (not shown). The control portion generates image data of the document sheet by executing an image process on the electric signal received from the CCD 27. It is noted that while an example of a reading mechanism using the CCD 27 as an imaging element is explained in the present embodiment, a reading mechanism using a contact image sensor (CIS) instead of the CCD 27 may also be applied.

The document sheet cover 12 is provided on an upper side of the image reading portion 11, rotatably attached to the housing 28. The document sheet cover 12 has a rotation shaft extending in the left-right direction on a rear end side of the upper portion of the housing 28, and is configured to be rotatable about the rotation shaft with respect to an upper surface of the housing 28. With rotation of the document sheet cover 12, the contact glasses 21 and 22 on an upper surface of the image reading portion 11 are opened and closed.

As shown in FIG. 2, the ADF 13 is provided on the document sheet cover 12. The ADF 13 conveys a document sheet such that the document sheet passes a predetermined reading position P10.

Figure 3:
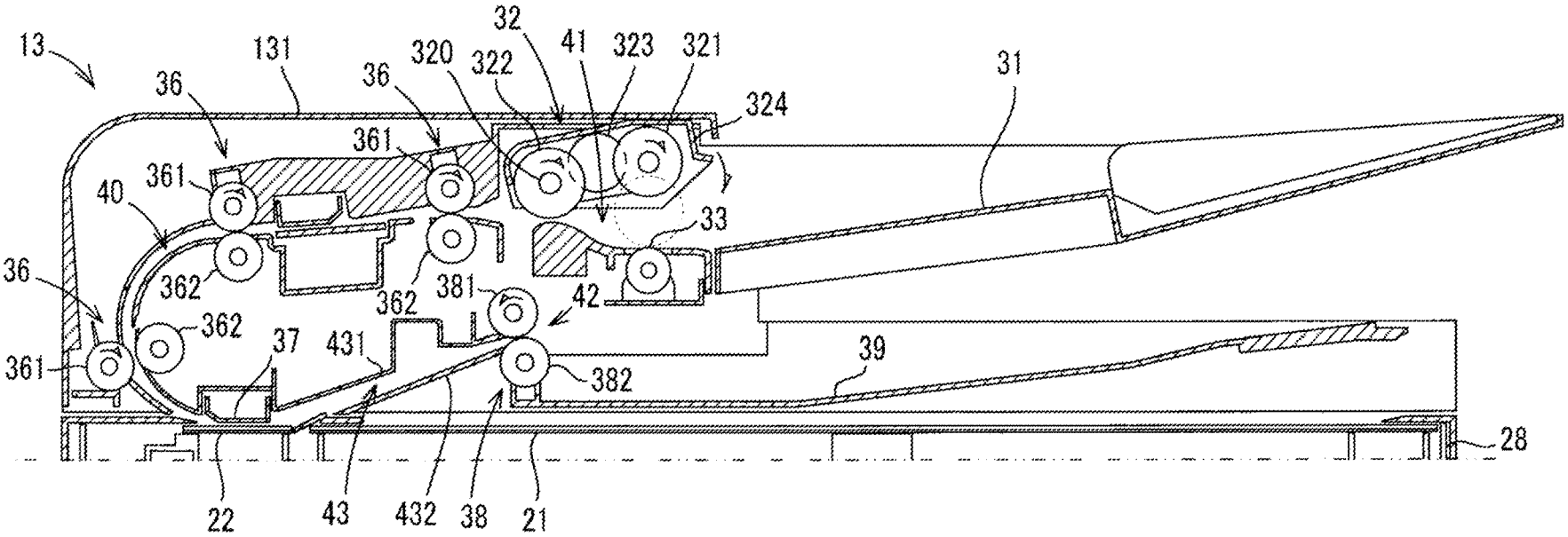
FIG. 3 is a cross-sectional diagram of an automatic document sheet feeder according to the embodiment of the present disclosure.

As shown in FIG. 3, the ADF 13 includes a document sheet tray 31 (an example of a feed sheet holding portion), a feeding unit 32, a separating roller 33, a plurality of conveying roller pairs 36, a document sheet presser 37, a discharging roller pair 38, and a discharge sheet tray 39 (an example of a discharge sheet holding portion).

The discharge sheet tray 39 is provided on an upper surface of the document sheet cover 12. The discharge sheet tray 39 is for stacking and holding therein one or more document sheets discharged by a driving roller 381 of the discharging roller pair 38, described later. The document sheet tray 31 is for stacking and holding therein one or more document sheets to be fed through the ADF 13, and is disposed above the discharge sheet tray 39.

The ADF 13 conveys the document sheet from the document sheet tray 31 to the discharge sheet tray 39 along a curved document sheet conveyance path 40. The document sheet conveyance path 40 is a path for conveying the document sheet, and extends leftward from the document sheet tray 31, curves downward, then extends rightward to the discharge sheet tray 39. A document sheet presser 37 is provided in the document sheet conveyance path 40 at a position opposite of the contact glass 21.

The feeding unit 32 is provided at a most upstream position in the document sheet conveyance path 40 in a conveyance direction of the document sheet, that is, a position near a feeding chute portion 41 that is an entrance to the document sheet conveyance path 40. The feeding unit 32 conveys the one or more document sheets stacked in the document sheet tray 31 to the document sheet conveyance path 40. The feeding unit 32 is attached to a housing 131 of the ADF 13. The feeding unit 32 includes a driving shaft 320 rotatably supported by the housing 131, a pickup roller 321 (an example of a second conveying roller), a feeding roller 322, an intermediate gear 323, and a holder 324 for rotatably supporting the driving shaft 320, the pickup roller 321, the feeding roller 322, and the intermediate gear 323.

The pickup roller 321 is rotatably supported on a side of the document sheet tray 31 (a right side) inside the holder 324. In addition, the holder 324 is rotatably supported by the driving shaft 320. Specifically, a bearing hole is formed at a left side end portion of the holder 324, and the driving shaft 320 is inserted in the bearing hole. In addition, the feeding roller 322 is attached on the driving shaft 320 inside the holder 324. With this configuration, the holder 324 is swingable about the driving shaft 320 between a feeding position (a position shown by the dashed line in FIG. 3) and a standby position (a position shown by the solid line in FIG. 3). When the holder 324 is at the feeding position, the pickup roller 321 comes in contact with an upper surface of an uppermost document sheet in the feeding chute portion 41, making it possible to feed the document sheet through the ADF 13, and when the holder 324 is at the standby position, the pickup roller 321 is positioned upward away from the upper surface of the document sheet.

The intermediate gear 323 is rotatably supported by the holder 324. The intermediate gear 323 engages with the feeding roller 322 and the pickup roller 321, and transmits driving force from the feeding roller 322 to the pickup roller 321.

A rotational driving force, output from a driving source such as a motor, is input to the driving shaft 320. The driving shaft 320 is connected to the feeding roller 322. Accordingly, when the driving shaft 320 is rotated, the feeding roller 322 rotates in the same direction as a rotational direction of the driving shaft 320. In addition, when the driving shaft 320 is rotated, a force in the same direction as the rotational direction of the driving shaft 320 is applied to the holder 324, due to friction generated between the bearing hole of the holder 324 and the driving shaft 320. With this configuration, when the driving shaft 320 is rotated clockwise (the direction of the arrow in FIG. 3), the holder 324 swings clockwise about the driving shaft 320, and is displaced from the standby position to the feeding position. At the feeding position, the pickup roller 321 is rotated clockwise, causing the uppermost document sheet in the feeding chute portion 41 to be fed out to the document sheet conveyance path 40. Hereinafter, the rotational direction (the direction of the arrows in FIG. 3) in which the driving shaft 320, the feeding roller 322, and the pickup roller 321 rotate when the document sheet is fed from the document sheet tray 31 to the document sheet conveyance path 40 is referred to as a forward rotational direction.

The plurality of conveying roller pairs 36 convey the document sheet in the document sheet conveyance path 40 in the conveyance direction. The plurality of conveying roller pairs 36 are provided along the document sheet conveyance path 40, spaced apart from each other by a predetermined distance. Each of the conveying roller pairs 36 include a driving roller 361 rotated by receiving a rotational driving force transmitted from the driving source such as a motor, and a driven roller 362 pressed against and driven by the driving roller 361. When the driving roller 361 is rotated clockwise (the direction of the arrow in FIG. 3) by receiving the rotational driving force from the driving source, the document sheet in the document sheet conveyance path 40 is conveyed downstream in the conveyance direction. Hereinafter, a rotational direction (the direction of the arrow in FIG. 3) in which the driving roller 361 rotates when the document sheet in the document sheet conveyance path 40 is conveyed downstream in the conveyance direction is referred to as the forward rotational direction.

The discharging roller pair 38 discharges the document sheet that has passed under the document sheet presser 37 from the document sheet conveyance path 40 to the external discharge sheet tray 39 via a document sheet discharge port 42 (an example of a sheet discharge port). In the present embodiment, two discharging roller pairs 38 are provided spaced apart from each other by a predetermined distance in a width direction (a direction orthogonal to the conveyance direction of the document sheet) of the document sheet discharge port 42 (see FIG. 4).

The two discharging roller pairs 38 are provided at a most downstream position in the document sheet conveyance path 40 in the conveyance direction of the document sheet. More specifically, the two discharging roller pairs 38 are provided on an end portion on a downstream side of a discharge path 43 in a discharge direction D10 (see FIG. 4 to FIG. 6). The discharge path 43 leads to the document sheet discharge port 42, the document sheet discharge port 42 being an exit of the document sheet conveyance path 40. Here, the discharge path 43 is a guide member for guiding the document sheet in the discharge direction D10, and is partitioned by an upper guiding plate 431 (an example of a guide frame) and a lower guiding plate 432, respectively disposed on an upper side and a lower side of the discharge path 43.

The discharging roller pair 38 includes the driving roller 381 (an example of first conveying roller) and a driven roller 382 (an example of a roller member). The driving roller 381 is rotatably supported above the end portion on the downstream side of the discharge path 43 in the discharge direction D10. Specifically, a rotational shaft 3811 is rotatably supported on an end portion on the downstream side of the upper guiding plate 431 in the discharge direction D10 (see FIG. 4 to FIG. 6), and two driving rollers 381 are attached to the rotational shaft 3811 spaced apart from each other in a shaft direction of the rotational shaft 3811. The two driving rollers 381 rotate by receiving rotational driving force transmitted to the rotational shaft 3811 from the driving source such as a motor. The driven roller 382 is provided beneath the driving roller 381. The driven roller 382 is pressed against a roller surface of the driving roller 381 by a spring or the like, thereby forming a nip portion 383 (see FIG. 5) between the driving roller 381 and the driven roller 382. When the driving roller 381 receives rotational driving force from the driving source and rotates counterclockwise (the direction of the arrow in FIG. 3), the driven roller 382 is driven to rotate. As a result, the document sheet in the document sheet conveyance path 40 is conveyed downstream in the discharge direction D10 while being nipped by the nip portion 383 between the driving roller 381 and the driven roller 382. Hereinafter, a rotational direction (the direction of the arrow in FIG. 3) in which the driving roller 381 rotates when the document sheet in the document sheet conveyance path 40 is conveyed downstream in the discharge direction D10 is referred to as the normal rotation direction.

Figure 4:
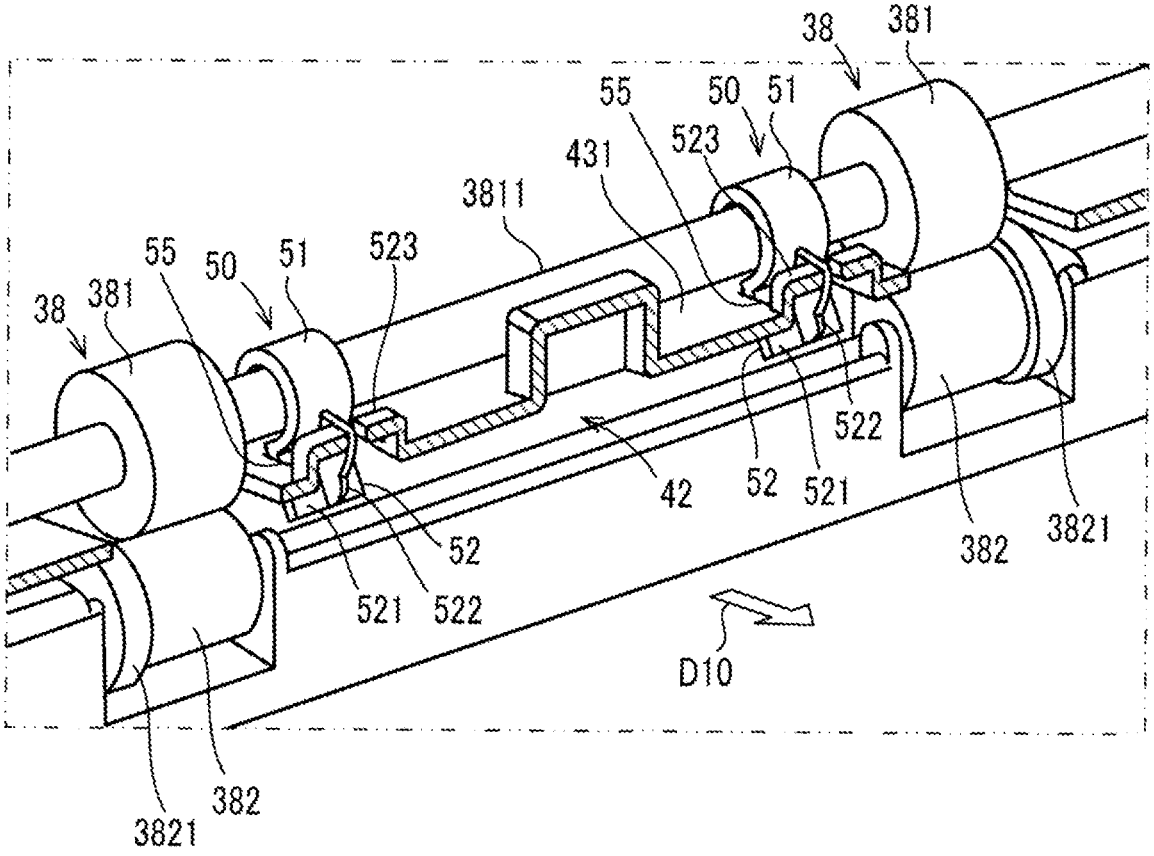
FIG. 4 is a perspective diagram showing a configuration near a document sheet discharge port.

The driven roller 382 is made of a synthetic resin such as polyacetal resin (POM), and has a narrow sponge roller 3821 made of a sponge material on an end portion on its outer side in the shaft direction as shown in FIG. 4. An outer diameter of the sponge roller 3821 is formed larger than an outer diameter of the driven roller 382. The sponge roller 3821 does not come in contact with the driving roller 381, and an outer peripheral end portion of the sponge roller 3821 is positioned on an outer side of the driving roller 381 in the shaft direction. When the document sheet is conveyed while being nipped by the nip portion 383 between the driving roller 381 and the driven roller 382, the sponge roller 3821 applies upward force on an end portion of the document sheet in a width direction. With this configuration, the document sheet that has passed through the nip portion 383 is discharged in a generally upward arc shape.

In the present embodiment, a common motor is used as the drive source for outputting the abovementioned rotational driving force input to the driving shaft 320, the driving roller 361, and the driving roller 381. That is, the rotational driving force output from the common motor is branched through various transmission members such as gears, and respectively input to the driving shaft 320, the driving roller 361, and the driving roller 381. Accordingly, when a rotational direction of the common motor is switched, the rotational direction of the driving shaft 320, the driving roller 361, and the driving roller 381 is also switched. Specifically, when the common motor is driven to rotate in a predetermined first rotational direction, the driving shaft 320, the driving roller 361, and the driving roller 381 are rotated in the forward rotational direction. Oppositely, when the common motor is rotationally driven in a second rotational direction opposite to the first rotational direction, the driving shaft 320, the driving roller 361, and the driving roller 381 are rotated in a direction opposite to the forward rotational direction (hereinafter referred to as a reverse rotational direction).

In addition, when all of the document sheets stacked in the document sheet tray 31 are conveyed and discharged to the discharge sheet tray 39, the ADF 13 displaces the holder 324 from the feeding position to the standby position as post-processing performed after completion of conveyance by the ADF 13. Specifically, when conveyance of the document sheet is completed, driving of the common motor is stopped, and thereafter, the common motor is driven for a predetermined period of time in the second rotational direction, opposite to the first rotational direction during feeding of the sheet. Accordingly, the driving shaft 320, the driving roller 361, and the driving roller 381 are rotated in the reverse rotational direction.

It is noted that the feeding unit 32 is provided with an interlocking mechanism (not shown) in which the holder 324 swings counterclockwise from the feeding position to the standby position, in conjunction with rotation of the driving shaft 320 when the driving shaft 320 is rotated in the reverse rotational direction. This interlocking mechanism is a known mechanism realized by, for example, a cam rotatably journaled on the driving shaft 320, a torsion coil spring provided on the driving shaft 320, or the like. In addition, the feeding unit 32 is provided with a known lock mechanism (not shown) for locking the holder 324 disposed at the standby position by the interlocking mechanism. The locking by the lock mechanism is released when the driving shaft 320 is rotated in the forward rotational direction, thereby allowing the holder 324 to be displaced from the standby position to the feeding position.

Meanwhile, when the holder 324 is displaced from the feeding position to the standby position, the driving roller 381 of the discharging roller pair 38 is rotated in the reverse rotational direction. With this configuration, when a large quantity of document sheets is stacked in the discharge sheet tray 39, there is a risk that at least one document sheet on top of the stack could be drawn into the ADF 13 by the driving roller 381. A possible way to prevent the driving roller 381 from rotating in the reverse rotational direction is to provide a one-way clutch or the like on the driving roller 381. However, providing the one-way clutch on the driving roller 381 would result in an increase in cost. In the present embodiment, stopper members 50 are provided in the ADF 13 for surely preventing document sheets discharged and stacked in the discharge sheet tray 39 from being drawn into the ADF 13 via the document sheet discharge port 42, even when the driving roller 381 rotates in the reverse rotational direction.

Figure 5:
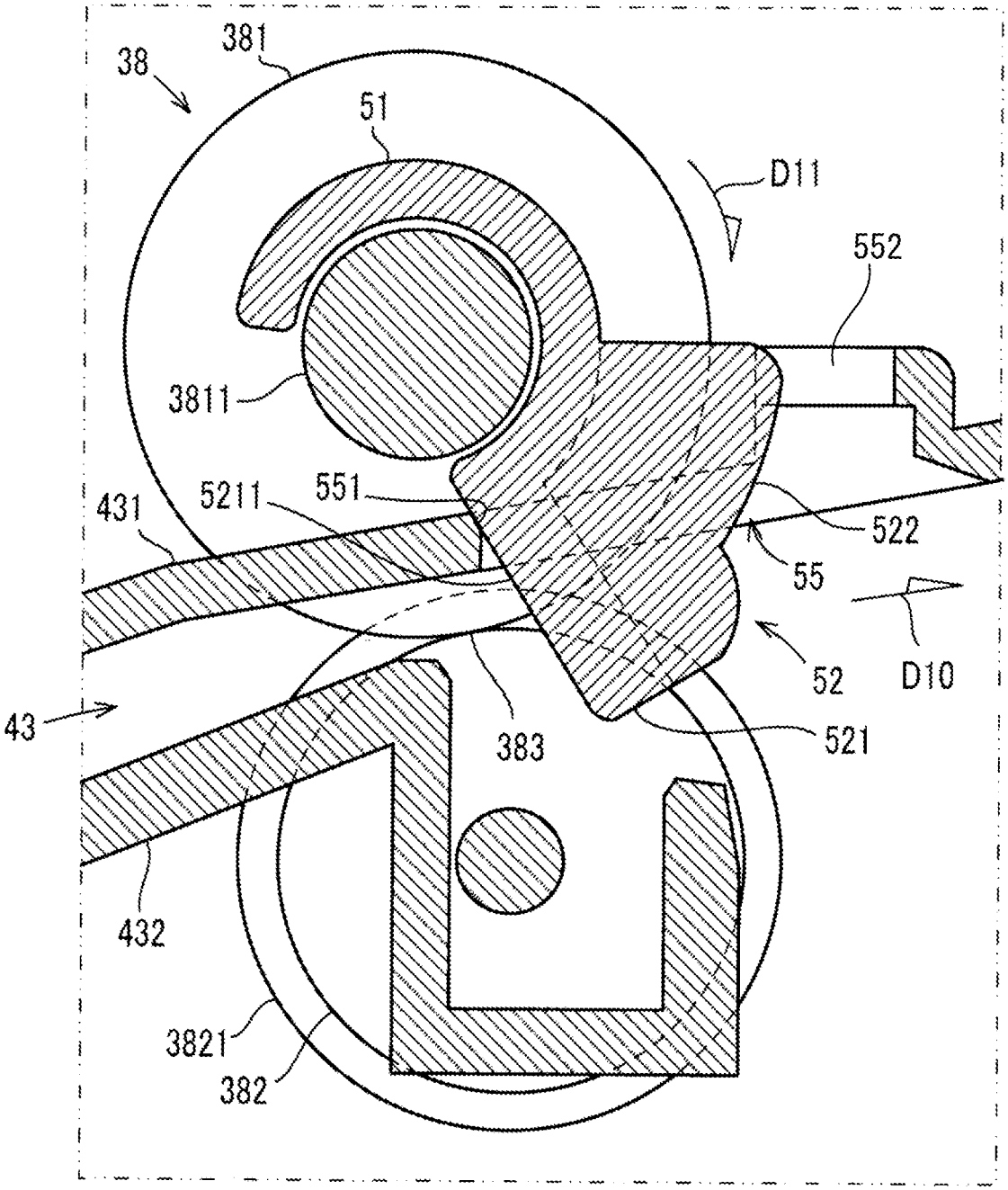
FIG. 5 is a cross-sectional diagram showing a cross-sectional configuration of a discharging roller pair.
Figure 6:
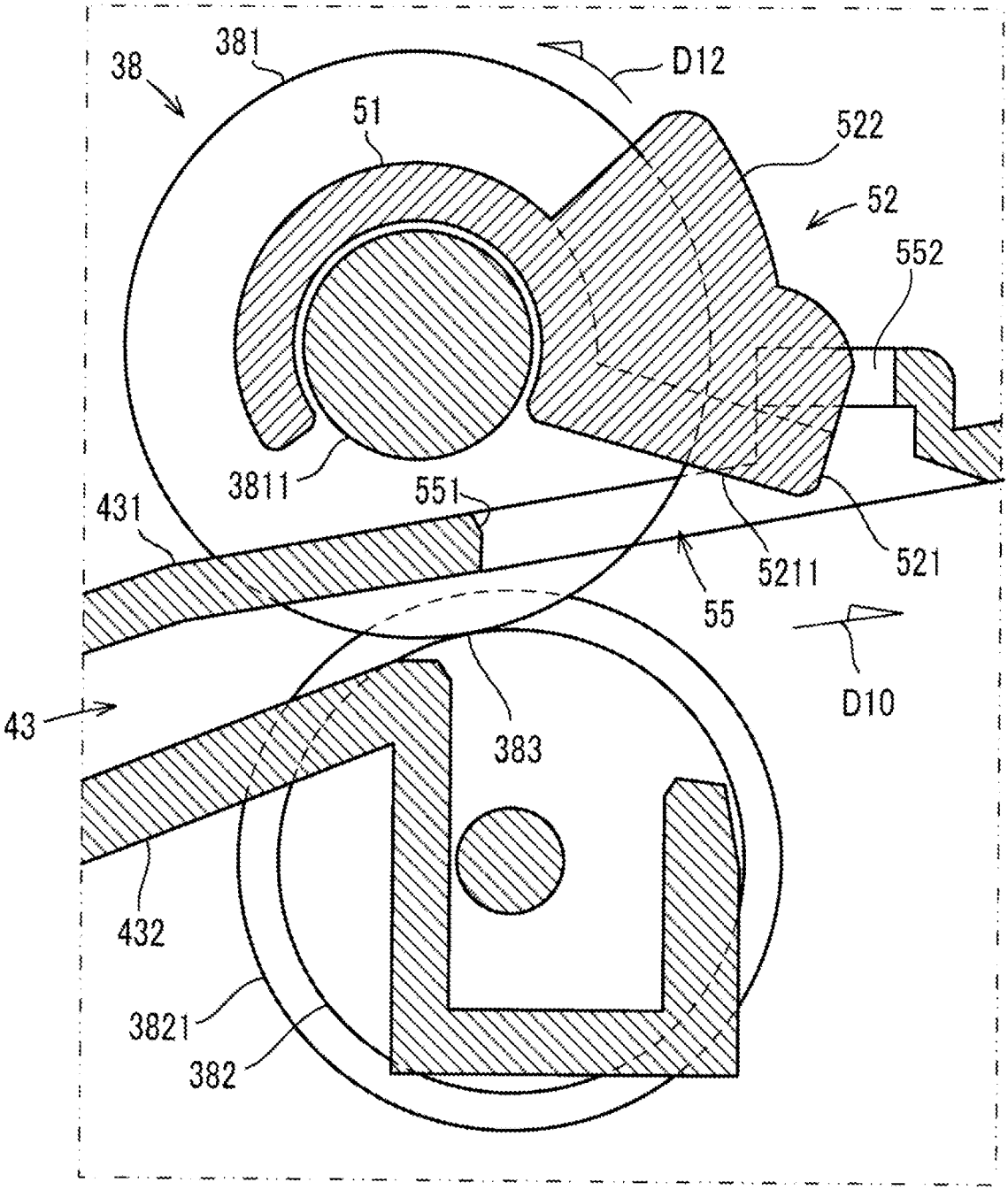
FIG. 6 is a cross-sectional diagram showing a cross-sectional configuration of a discharging roller pair.

A configuration and an operation of the stopper members 50 are described below with reference to FIG. 4 to FIG. 6. Here, FIG. 4 is a perspective view showing a configuration near the document sheet discharge port 42 when viewing the document sheet discharge port 42 from a side of the discharge sheet tray 39. It is noted that FIG. 4 shows a state in which a portion in the upper guiding plate 431 of the discharge path 43, downstream in the discharge direction D10, is cut. In addition, FIG. 5 and FIG. 6 show cross-sectional structures of the discharging roller pair 38. FIG. 4 and FIG. 5 show a state in which the stopper member 50 is disposed at an intersecting position where the stopper member 50 intersects the document sheet discharge port 42. FIG. 6 shows a state in which the stopper member 50 is retracted toward the upper guiding plate 431 at a retracted position.

As shown in FIG. 4, two stopper members 50 are provided near the document sheet discharge port 42. The two stopper members 50 prevent the document sheet in the discharge sheet tray 39 from intruding into the nip portion 383 of the discharging roller pair 38, when the driving roller 381 is rotated in the reverse rotational direction. The two stopper members 50 are swingably supported on the rotational shaft 3811 of the driving roller 381, and extend in a direction (intersecting direction) intersecting the document sheet discharge port 42 on a side further downstream than the nip portion 383 in the discharge direction D10. In the present embodiment, the two stopper members 50 are provided on a side further inward in the ADF 13 than the document sheet discharge port 42, and near the driving rollers 381, or more specifically, respectively on inner sides of the two driving rollers 381 in a width direction.

The stopper members 50 are made of a synthetic resin, and includes shaft supporting portions 51 integrally formed with projecting portions 52. The shaft supporting portions 51 are rotatably supported by the rotational shaft 3811 of the driving roller 381, and generally have a shape of a C in the Roman alphabet when viewed cross-sectionally. The shaft supporting portions 51 are attached to the rotational shaft 3811 in such a way that the shaft supporting portions 51 grasp the rotational shaft 3811, and this allows for the rotational shaft 3811 to be rotatably supported. In a state in which the driving roller 381 is not rotating, the projecting portions 52 project obliquely downward from the shaft supporting portions 51 toward a downstream side of the discharge direction D10, and intersect the document sheet discharge port 42. In addition, since the shaft supporting portions 51 have the C-shaped cross section, by pressing opening portions of the shaft supporting portions 51 on the rotational shaft 3811, the shaft supporting portions 51 are widened in a radial direction from its opening portion, and when the shaft supporting portions 51 return to their original shape, the shaft supporting portions 51 grasp and are attached to the rotational shaft 3811. In this way, since the shaft supporting portions 51 have the C-shaped cross section, the stopper members 50 can be easily attached to the rotational shaft 3811 without using a tool.

As shown in FIG. 4 and FIG. 5, an opening 55 (an example of an opening portion of the present invention) through which the projecting portion 52 passes through the upper guiding plate 431 to the discharge path 43 is formed in the upper guiding plate 431. The opening 55 is a through-hole passing through the upper guiding plate 431. When the projecting portion 52 is inserted downward through the opening 55, the projecting portion 52 intersects the document sheet discharge port 42 on a side further downstream than the nip portion 383 in the discharge direction D10.

The projecting portion 52 includes a flat plate piece 521 projecting outward from an outer peripheral surface of the shaft supporting portion 51, integrally formed with a vertical rib 522 (an example of a restricting rib in the present invention) provided on the flat plate piece 521. The vertical rib 522 vertically projects from a downstream side of a flat surface on the flat plate piece 521 in the discharge direction D10. This vertical rib 522 extends in a protruding direction of the flat plate piece 521 from the center of the surface of the flat plate piece 521 in a width direction.

In the present embodiment, the projecting portion 52 of the stopper member 50 is disposed at the intersecting position (the position shown in FIG. 4 and FIG. 5) where the projecting portion 52 intersects the document sheet discharge port 42, such that the document sheet moving toward the nip portion 383 does not intrude into the discharge path 43 from the document sheet discharge port 42. In the present embodiment, as shown in FIG. 5, a restricting portion 551 (an example of a restricting portion) is provided on an edge portion on an upstream side of the opening 55 in the discharge direction D10. The restricting portion 551, in a state where the projecting portion 52 is disposed at the intersecting position, comes in contact with a side surface 5211 on an upstream side of the flat plate piece 521 of the stopper member 50 in the discharge direction D10. This allows for the stopper member 50 to be restricted from rotating toward the nip portion 383 from the intersecting position by the restricting portion 551, and kept in the intersecting position. In other words, the restricting portion 551 restricts the stopper member 50 from rotating toward the nip portion 383 from the intersecting position.

As shown in FIG. 5 and FIG. 6, a restricting groove 552 is formed at an end portion on a downstream side of the opening 55 in the discharge direction D10, the restricting groove 552 being configured to restrict movement of the stopper member 50 in the width direction. The restricting groove 552 is formed on a swollen wall 523 swelling upwards from the end portion on the downstream side of the opening 55 in the discharge direction D10. The swollen wall 523 has an eave shape bending upward from the end portion on the downstream side of the opening 55 in the discharge direction D10, and extending upstream in the discharge direction D10. The restricting groove 552 is formed in the center of the swollen wall 523 in a width direction. In a state where the stopper member 50 is attached to the rotational shaft 3811, the vertical rib 522 is inserted into the restricting groove 552. This allows for the vertical rib 522 and the restricting groove 552 to restrict the stopper member 50 from moving in the shaft direction of the rotational shaft 3811.

In the present embodiment, since the abovementioned stopper member 50 is provided in the ADF 13, when the driving roller 381 of the discharging roller pair 38 rotates in the reverse rotational direction (the direction shown by the arrow D11 in FIG. 5), the stopper member 50 is disposed at the intersecting position (see FIG. 5). In this state, even if the one or more document sheets stacked in the discharge sheet tray 39 intrudes into the discharge path 43 from the document sheet discharge port 42, a front end of the document sheet comes in contact with the vertical rib 522. With this configuration, the document sheet stops at a position where it comes in contact with the vertical rib 522, that is, the document sheet stops at a position separated a length of the vertical rib 522 from the flat plate piece 521 in the discharge direction D10, and does not come in contact with the nip portion 383. As a result, even if the large quantity of document sheets is stacked in the discharge sheet tray 39, the document sheets in the discharge sheet tray 39 are prevented from being drawn into the ADF 13 by the driving roller 381 rotating in the reverse rotational direction.

On the other hand, when the driving roller 381 of the discharging roller pair 38 rotates in the forward rotational direction (the direction shown by the arrow D12 in FIG. 6), the stopper member 50 is displaced from the intersecting position to the retracted position (see FIG. 6). In the retracted position, since the stopper member 50 is not positioned to hinder discharge of the document sheet, the document sheet is smoothly discharged from the document sheet discharge port 42 to the discharge sheet tray 39. That is, the stopper member 50 allows the document sheet to be discharged from the document sheet discharge port 42 to the discharge sheet tray 39. It is noted that when the stopper member 50 rotates to the retracted position, since the flat plate piece 521 comes in contact with a bottom surface of the swollen wall 523, the stopper member 50 maintains being disposed at the retracted position.

It is noted that while the embodiment described above illustrates an example of a configuration in which two stopper members 50 are respectively provided on inner sides of two driving rollers 381, the present embodiment is not limited to this configuration. For example, if three or more driving rollers 381 are provided, a configuration in which two stopper members 50 are respectively provided on inner sides of two driving rollers 381 of the three or more driving rollers 381, disposed on outermost sides in the width direction, is also acceptable.

In addition, while the embodiment described above illustrates an example of a configuration in which two driving rollers 381 are attached to the rotational shaft 3811, for example, a configuration in which one driving roller 381 elongated in the shaft direction is attached to the rotational shaft 3811 is also acceptable. In this case, the stopper member 50 is provided on one or both of two sides of the driving roller 381 in the shaft direction.

In addition, while the embodiment described above illustrates an example of a configuration including two stopper members 50, a configuration including at least one stopper member 50 is acceptable. In this case, the stopper member 50 is provided in the center of the rotational shaft 3811 in the shaft direction.

Figure 7:
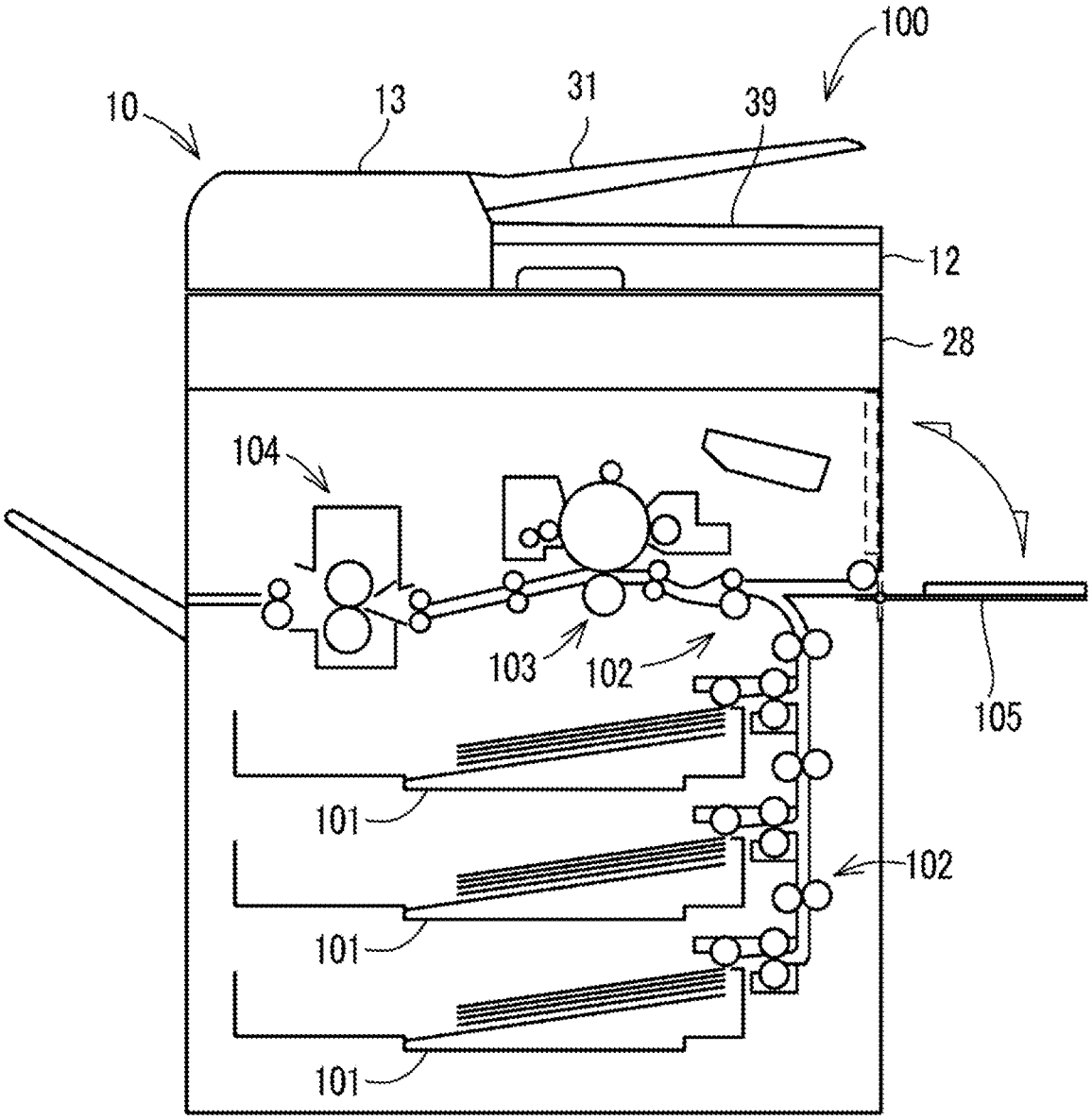
FIG. 7 is a schematic diagram showing a configuration of an image forming apparatus according to another embodiment of the present disclosure.

In addition, while the embodiment described above illustrates the ADF 13 and the image reading device 10 including the ADF 13 as one embodiment of the present disclosure, the present disclosure is not limited to this configuration. As shown in FIG. 7, an image forming apparatus 100 may also be applied to the present disclosure, the image forming apparatus 100 including a plurality of sheet feeding trays 101, a plurality of conveying portions 102, a transfer device 103, a fixing device 104, a manual feeding tray 105, the ADF 13, and the image reading device 10. The image forming apparatus 100 is configured to read an image from a document sheet conveyed by the ADF 13 using the image reading device 10, and form the image on printing paper based on the read image.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet conveying device, comprising:

a discharge path configured to guide a sheet member to a sheet discharge port;

a guide frame to form a conveyance path;

a discharging roller pair configured to be rotatable in a forward rotational direction and a reverse rotational direction, and discharge the sheet member outside from the sheet discharge port by rotating in the forward rotational direction, wherein the discharging roller pair includes a first conveying roller and a roller member which is provided beneath the first conveying roller and configured to come in contact with a roller surface of the first conveying roller and form a nip portion between the first conveying roller and the roller member;

a discharge sheet holding portion configured to hold the sheet member discharged outside by the discharging roller pair; and a stopper member which is swingably supported on a rotational shaft of the first conveying roller, so as to project toward an intersecting direction and intersect the sheet discharge port on a side further downstream than the nip portion in a discharge direction of the sheet member, wherein the stopper member is configured to allow the sheet member to be discharged to the discharge sheet holding portion when the discharging roller pair rotates in the forward rotational direction, and prevent the sheet member from intruding into the nip portion from the discharge sheet holding portion when the discharging roller pair rotates in the reverse rotational direction, the first conveying roller is rotatably supported above an end portion on a downstream side of the discharge path in the discharge direction, the stopper member includes a shaft supporting portion and a projecting portion, the shaft supporting portion has a C-shaped cross section and is supported to be rotatable about the rotational shaft, and the projecting portion projects toward the intersecting direction from an outer peripheral surface of the shaft supporting portion and intersects the sheet discharge port, the projecting portion includes a flat plate piece projecting outward from the outer peripheral surface of the shaft supporting portion, and a restricting rib projecting from a downstream side of a flat surface of the flat plate piece in the discharge direction and extending in a protruding direction of the flat plate piece, the guide frame includes an opening portion formed on a side further downstream in the discharge direction than the nip portion, the opening portion has an opening through which the projecting portion passes through to the discharge path and a restricting portion provided on an edge portion on an upstream side of the opening portion in the discharge direction, and the restricting portion is configured to restrict the flat plate piece from being displaced toward the nip portion by coming in contact with a side surface on an upstream side of the flat plate piece in the discharge direction.

2. The sheet conveying device according to claim 1, wherein the shaft supporting portion of the stopper member is attached near the first conveying roller on the rotational shaft.

3. The sheet conveying device according to claim 2, wherein the first conveying roller includes a plurality of first conveying rollers which are provided on the rotational shaft spaced apart from each other in a shaft direction of the rotational shaft, and the stopper member includes two stopper members which are provided respectively on inner sides of two first conveying rollers of the plurality of first conveying rollers that are disposed on outermost sides in the shaft direction.

4. An image reading device configured to read an image from the sheet member being conveyed by the sheet conveying device, comprising:

the sheet conveying device according to claim 1.

5. An image forming apparatus configured to form an image on the sheet member being conveyed by the sheet conveying device, comprising:

the sheet conveying device according to claim 1.

* * * * *